US009469963B2

(12) United States Patent
Hiester

(10) Patent No.: US 9,469,963 B2
(45) Date of Patent: Oct. 18, 2016

(54) CANTILEVERED WING WALL

(71) Applicant: Oldcastle Precast, Inc., Auburn, WA (US)

(72) Inventor: Steven C. Hiester, Maple Valley, WA (US)

(73) Assignee: Oldcastle Precast, Inc., Auburn, WA (US)

( * ) Notice: Subject to any disclaimer, the term of this patent is extended or adjusted under 35 U.S.C. 154(b) by 0 days.

(21) Appl. No.: 14/874,951

(22) Filed: Oct. 5, 2015

(65) Prior Publication Data

US 2016/0024742 A1 Jan. 28, 2016

Related U.S. Application Data

(63) Continuation of application No. 14/064,836, filed on Oct. 28, 2013, now Pat. No. 9,157,211.

(51) Int. Cl.
*E02D 29/02* (2006.01)
*B28B 1/14* (2006.01)

(52) U.S. Cl.
CPC ..... *E02D 29/0266* (2013.01); *B28B 1/14* (2013.01); *E02D 29/0275* (2013.01)

(58) Field of Classification Search
USPC ..... 405/284, 286, 287
See application file for complete search history.

(56) References Cited

U.S. PATENT DOCUMENTS

| | | | | |
|---|---|---|---|---|
| 3,794,433 | A | 2/1974 | Schupack | |
| 3,906,687 | A | 9/1975 | Schupack | |
| 4,635,895 | A | 1/1987 | Johnson, Jr. et al. | |
| 4,668,129 | A | 5/1987 | Babcock et al. | |
| 5,492,438 | A * | 2/1996 | Hilfiker | E02D 29/0241 405/285 |
| 5,533,839 | A | 7/1996 | Shimada | |
| 6,158,184 | A | 12/2000 | Timmerman, Sr. et al. | |
| 6,244,004 | B1 | 6/2001 | Timmerman, Sr. et al. | |
| 6,491,473 | B2 | 12/2002 | Veazey | |
| 7,251,920 | B2 | 8/2007 | Timmerman, Sr. et al. | |
| 7,506,479 | B2 | 3/2009 | Pryor | |
| 7,896,582 | B2 * | 3/2011 | Chouery | E02D 29/02 405/262 |
| 8,136,260 | B1 | 3/2012 | Jones | |
| 9,157,211 | B2 * | 10/2015 | Hiester | E02D 29/0275 |
| 2003/0136075 | A1 | 7/2003 | Brackett | |
| 2008/0104909 | A1 | 5/2008 | Wallin | |

(Continued)

FOREIGN PATENT DOCUMENTS

| | | |
|---|---|---|
| WO | WO 87/01406 | 3/1987 |
| WO | WO 96/11309 | 4/1996 |

OTHER PUBLICATIONS

"Abutments," WisDOT Bridge Manual, Chapter 12, Jul. 2013, 38 pages.

(Continued)

*Primary Examiner* — Sean Andrish
(74) *Attorney, Agent, or Firm* — Sheridan Ross P.C.

(57) ABSTRACT

The present invention relates generally to precast cantilevered retaining walls and methods of using and forming precast cantilevered retaining walls. More specifically, the present invention relates to a cantilevered concrete retaining wall having a base shear key and blockouts for receiving a material that substantially impedes the wing wall from sliding or other inadvertent movement, to a method of retaining a soil embankment with a cantilevered concrete retaining wall, and to a method of manufacturing a precast concrete cantilevered retaining wall.

19 Claims, 5 Drawing Sheets

(56) References Cited

U.S. PATENT DOCUMENTS

| | | | | |
|---|---|---|---|---|
| 2008/0163577 | A1 | 7/2008 | Rhodes et al. | |
| 2010/0325819 | A1 | 12/2010 | Abreu | |
| 2012/0204508 | A1 | 8/2012 | Kalwara et al. | |
| 2014/0270990 | A1* | 9/2014 | Heraty | E02D 29/0266 405/286 |

OTHER PUBLICATIONS

"Retaining Walls," WisDOT Bridge Manual, Chapter 14, Jul. 2013, 258 pages.
"Retaining Walls," Section 5, Caltrans Bridge Design Specifications, Aug. 2004, pp. 1-106.
"Substructures," NDOT Structures Manual, Chapter 18, Sep. 2008, 24 pages.
Bowles, "Mechanically Stabilized Earth and Concrete Retaining Walls," in Foundation Anaysis and Design, McGraw Hill Book Co., New York, 5th ed, 2009, pp. 552-553.
Ashford et al., "Seismic Response and Capacity Evaluation of Exterior Sacrificial Shear Keys of Bridge Abutments," 2009 Caltrans-PEER Seismic Seminar Series, 17 pages.
Prieto-Portar, "Types of Retaining Walls," Foundation Engineering Lecture #23, 2008, available at www.sefindia.org/rangarajan/retainingWalls.pdf, 76 pages.
Official Action for U.S. Appl. No. 14/064,836, mailed Feb. 6, 2015, 14 pages.
Notice of Allowance for U.S. Appl. No. 14/064,836, mailed Jul. 7, 2015, 7 pages.

* cited by examiner

CANTILEVERED WING WALL

CROSS-REFERENCE TO RELATED APPLICATIONS

This Application is a continuation of U.S. patent application Ser. No. 14/064,836, filed Oct. 28, 2013, entitled "Cantilevered Wing Wall," which is incorporated herein in its entirety by reference.

FIELD OF THE INVENTION

The present invention relates generally to precast cantilevered retaining walls. More specifically, the present invention relates to a cantilevered concrete retaining wall having a base shear key and blockouts for receiving a material that substantially impedes the wing wall from sliding or other inadvertent movement.

BACKGROUND

Retaining walls are subject to various forces that may cause them to fail. Pressure at the toe of the footing is generally larger than pressure at the heel of the footing so retaining walls have an inherent tendency to tilt forward away from an embankment. Occasionally, the base soil is of a poor quality and when sufficient backfill is placed between the backface of the retaining wall and an embankment, for example, the approach fill at a bridge abutment, the backfill pressure produces a settlement with lateral effect into the zone beneath the heel so that the retaining wall may tilt back into the backfill and the embankment. Lateral forces generated by earth and water pressure may cause the base of the retaining wall to slide outward and fail. Retaining walls are generally designed to resist these lateral forces by creating friction between the bottom surface of the footing and the soil. Some soil types are more prone to shifting or erosion and may decrease the friction between the footing and soil. Different soil types exert different amounts of pressure on the retaining wall. Local soil conditions may require an increase in the width of the footing to achieve the required friction between the bottom surface of the retaining wall and the soil to counteract the lateral forces on the retaining wall. However, making the footing wider increases the amount of materials used, increases transportation costs, and requires increased excavation of soil to form a wider subgrade which increases cost and time required for site preparation and installation. In some cases, it may not be possible to increase the footing width based on site requirements. The depth of the footing cover can also be increased in some situations to provide additional resistance to lateral forces; however, this also increases the cost of site preparation because excavation must be deeper, and additional concrete is required which increases costs as well.

Concrete retaining walls that are cast-in-place at the job site are known to have a higher coefficient of friction between the footing and the soil compared to precast concrete retaining walls that are manufactured at a precast plant, transported to the job site, and placed on the soil. However, there are several shortcomings in the use of cast-in-place retaining walls compared to the use of precast concrete retaining walls. Creating forms for a retaining wall at a job site is time consuming and may require the presence of many employees at a remote location. The job site may not be as safe for employees as a precast plant due to open excavations, the presence of heavy equipment, and the natural environment. The forms may have to be custom made, increasing labor and material costs and making re-use of the forms unlikely. Placing and aligning reinforcing steel precisely at a job site may be more difficult than at a precast plant, potentially weakening the retaining wall. The concrete for the retaining walls may have to be transported long distances to the job site in individual truckloads increasing transportation and labor costs. Finally, the concrete is exposed to the environment while it is curing which can increase the curing time or adversely affect the strength characteristics of the retaining wall. Construction of the project may be delayed while waiting for the concrete to cure.

Due to the numerous limitations associated with cast-in-place retaining walls, there is an unmet need for a precast concrete retaining wall which has a coefficient of friction equivalent to a cast-in-place retaining wall of similar size.

SUMMARY OF THE INVENTION

In view of the limitations in prior art retaining walls and methods of using them, the present disclosure provides a new and useful precast cantilevered wing wall and a method of use thereof which is cost effective to fabricate, more versatile in use than known prior art retaining walls, and less susceptible to failure.

One aspect of the present disclosure is to provide a new precast cantilevered wing wall and method of use thereof that prevents the cantilevered wing wall from sliding or other inadvertent movement. Another aspect of the present disclosure is to provide a new precast cantilevered wing wall that has many novel features not offered by the prior art. One such feature is a base shear key or stem wall adapted to fit into a trench formed in the subgrade beneath the footing of the cantilevered wing wall. Another novel feature includes one or more blockouts formed through the footing. The precast cantilevered wing wall and base shear key are placed on the prepared subgrade and the base shear key is placed in the trench. A material that replicates the strength of compacted soil is poured or deposited through the blockouts to fill voids between the soil of the subgrade and the shear key to lock the cantilevered wing wall in place. The material may be any material that fills the voids and replicates the strength of compacted soil such as grout, cement, concrete, mortar, controlled density fill, adhesives, hydro compacted sand, or any combination thereof.

In one embodiment, the cantilevered wing wall may be assembled from individual precast concrete sections. In another embodiment, the cantilevered wing wall may be precast monolithically as one integral piece without any individual components, joints, or necessity to interconnect any components.

In one embodiment, a method of retaining an embankment with a precast cantilevered wing wall is disclosed, the method generally comprising (1) providing a precast cantilevered wing wall having a stem of a predetermined height, length, and thickness, a footing interconnected to the stem, the footing extending laterally from a front face of the stem to form a toe and the footing extending laterally from a back face of the stem to form a heel, the footing having a predetermined thickness, a base shear key extending downwardly a predetermined depth from a substantially horizontal plane defined by the footing, and a plurality of blockouts formed through the footing between the stem and the base shear key, wherein each of the plurality of blockouts have a sufficient dimension to receive a grout material; (2) excavating soil to form a subgrade of a determined width, length, and depth; (3) excavating soil to form a trench of a second determined width, length, and depth in the subgrade; (4) placing the cantilevered wing wall on the subgrade, wherein the base shear key of the cantilevered wing wall extends at least partially into the trench; and (5) filling the trench and at least one of the plurality of said blockouts at least partially with the grout material that fills the void between footing and the subgrade, wherein the grout material replicates the strength of compacted soil, wherein said grout material comprises at least one of a grout, a cement, a concrete material, a mortar, a controlled density fill, an adhesive, a hydro compacted sand, a controlled density fill, and an aggregate, or any combination thereof.

In one embodiment, the subgrade soil may optionally be compacted to a determined density. In another embodiment, at least one blockout may be formed through the footing between the stem and the toe. In yet another embodiment, the footing may be formed without the base shear key. In another embodiment, drain holes may be formed through the stem. In yet another embodiment, a drainage system may optionally be installed between the back face of the stem and the embankment. In still another aspect for further stabilization, one or more soil nails may optionally be installed through at least one of the plurality of said blockouts. In another embodiment, anchors may be embedded within the precast cantilevered wing wall so that the cantilevered wing wall can be lifted, transported, and placed in a position of use. The method may further optionally comprise placing infill material between the wall and the embankment to a determined height, placing second infill material in front of the stem above the footing to a final grade line, and compacting the infill material and the second infill material to a second determined density.

In another embodiment, a precast cantilevered wing wall is disclosed, the cantilevered wing wall comprising: a stem of a predetermined height, length, and thickness; a footing connected to the stem, the footing extending laterally from a front face of the stem to form a toe and the footing extending laterally from a back face of the stem to form a heel; and a plurality of blockouts formed through the footing, wherein each of the plurality of blockouts have a sufficient size to receive at least one of a grout material and a reinforcing bar. In an embodiment, the plurality of blockouts may optionally be comprised of two or more rows of blockouts. In another embodiment, at least one blockout is formed between stem and the toe. In yet another embodiment, the plurality of blockouts may optionally be formed through the footing to have an irregular spacing. In still another optional embodiment, the blockouts may have a shape resembling at least one of a parallelogram, a square, a rectangle, a circle, a triangle or any combination thereof. In one embodiment, a base shear key extends down a predetermined depth from a substantially horizontal plane defined by the footing. In another embodiment, the stem has a first predetermined height on a right side of the cantilevered wing wall and a second predetermined height on a left side of the cantilevered wing wall and the first predetermined height is optionally greater than the second predetermined height. In still another embodiment, the first predetermined height is optionally less than the second predetermined height. In yet another embodiment, the plurality of blockouts have an irregular spacing. In still another embodiment, the plurality of blockouts are formed through the footing between the stem and a rear portion of the heel. In another embodiment, at least one of the plurality of blockouts is formed between the stem and a forward-most portion of the toe. In yet another embodiment, the cantilevered wing wall further comprises anchors, the anchors having a first end at least partially embedded in the concrete and a second end adapted to be manipulated by lifting equipment to lift, transport, and/or place the cantilevered wing wall in a position of use.

In yet another embodiment, a method of manufacturing a monolithic precast concrete cantilevered retaining wall is disclosed and which generally comprises (1) creating a form which defines the geometry of the retaining wall wherein the form comprises a stem of a predetermined height, length, and thickness, a footing connected to the stem, the footing having a predetermined thickness and extending laterally a width from a front face of the stem to form a toe and extending laterally a width from a back face of the stem to form a heel, optionally a shear key extending down a predetermined depth from a substantially horizontal plane defined by the footing, and a plurality of blockouts through the footing; (2) placing reinforcing steel in the form; (3) pouring a predetermined volume of concrete into the form; and (4) removing the form after the concrete has cured, wherein the precast concrete cantilevered retaining wall can be lifted, transported, and place in a position of use. In one embodiment, the plurality of blockouts are formed between the stem and the heel to create a void adapted to receive reinforcing materials such as metal rebar and/or steel. In one optional embodiment, at least one blockout is formed between the stem and the toe. In still another embodiment, the plurality of blockouts may have an irregular size. In yet another embodiment, a shape of at least one of the plurality of blockouts differs from a second shape of a second of the plurality of blockouts. In yet another embodiment, anchors may be embedded within the precast cantilevered wing wall, the anchors having a first end at least partially embedded within the cantilevered wing wall and a second end adapted to be engaged by lifting hardware to lift, transport, and place the cantilevered wing wall in a position of use.

Additional features and advantages of embodiments of the present disclosure will become more readily apparent from the following discussion, particularly when taken together with the accompanying drawings.

References made herein to a "cantilevered wing wall" or aspects thereof should not necessarily be construed as limiting the present invention to a particular type of retaining structure. It will be recognized by one skilled in the art that the present invention may be used with other types of structures such as gravity walls, semi-gravity wall, conventional walls, non-gravity cantilevered wall, anchored walls, abutments, culverts, retaining walls, wing walls, and the like to retain an embankment. Accordingly, the term "cantilevered wing wall" is intended to cover all types of structures designed to retain an embankment of any type.

The terms "grout material" or "grout" as used herein refer to any material that replicates the strength of compacted soil. Such materials includes, but are not limited to, grout, cement, concrete, mortar, putty, plastic, polymer concrete, aggregate, controlled density fill, adhesives, hydro compacted sand, or any combination thereof, or similar binding materials that may be represented in a variety of types and composition mixes having various combinations of ingredients as will be recognized by one of skill in the art.

The phrase "material that replicates the strength of compacted soil" as used herein refers to any material such as grout, cement, concrete, mortar, controlled density fill, adhesives, concrete, hydro compacted sand, or any combination thereof used to fill voids and/or trenches beneath a footing of a cantilevered wing wall.

Although generally referred to herein a "precast" cantilevered wing wall, aspects of the present invention may be used with cast-in-place cantilevered wing walls as will be recognized by one of skill in the art.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the summary of the invention given above and the detailed description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 1:
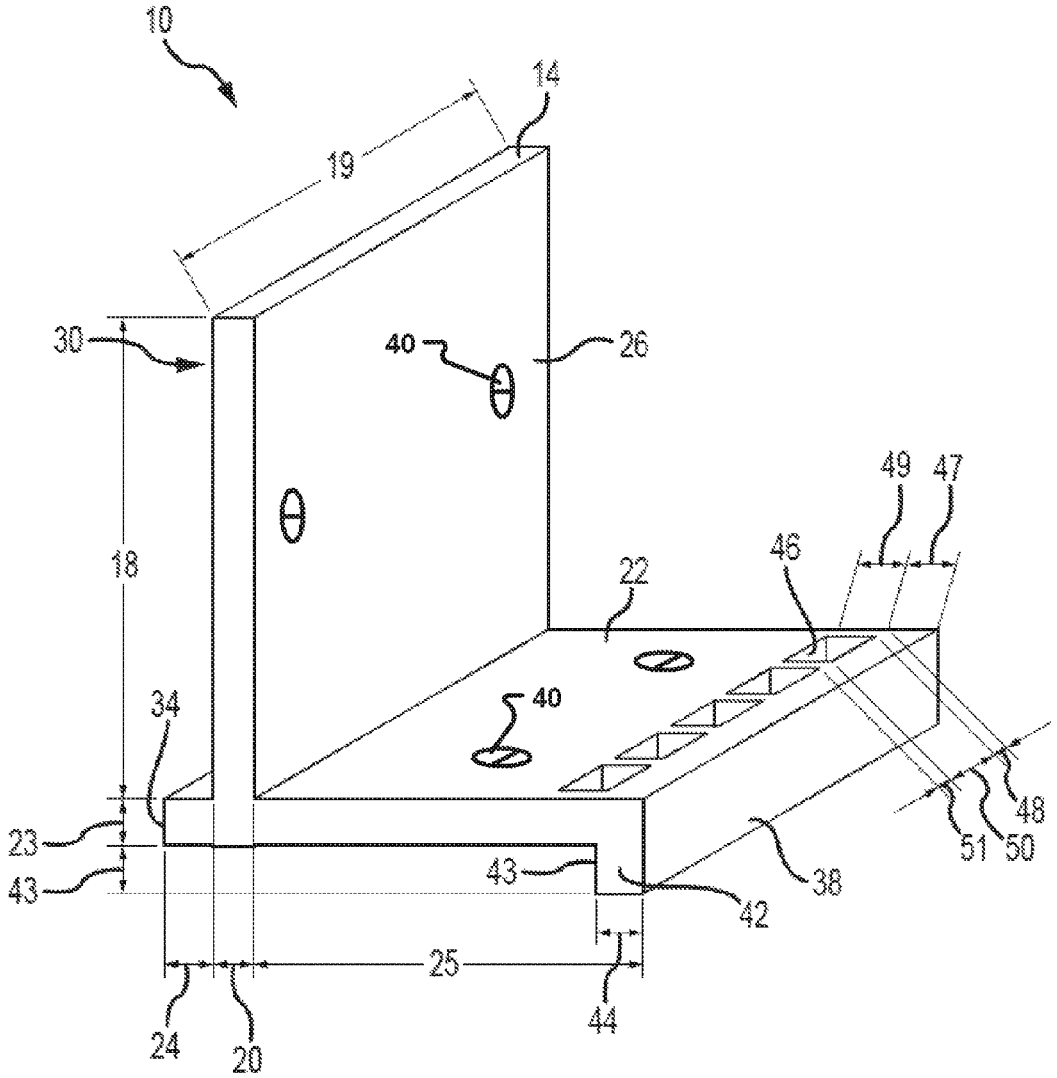
FIG. 1 is an isometric view of a cantilevered wing wall according to one embodiment.

A component list of the various components shown in drawings is provided herein:

| Number | Component |
|---|---|
| 10 | cantilevered wing wall |
| 14 | stem |
| 18 | stem height |
| 19 | stem length |
| 20 | stem thickness |
| 22 | footing |
| 23 | footing thickness |
| 24 | toe width |
| 25 | heel width |
| 26 | back face |
| 30 | front face |
| 34 | toe |
| 38 | heel |
| 40 | anchor |
| 42 | base shear key |
| 43 | depth |
| 44 | width |
| 46 | blockouts |
| 46A | circular blockout |
| 47 | distance from heel |
| 48 | distance from edge |
| 49 | blockout width |
| 50 | blockout length |
| 51 | distance of separation |
| 52 | joint |
| 54 | embankment |
| 58 | subgrade |
| 62 | subgrade depth |
| 66 | footing cover |
| 70 | final grade |
| 74 | trench |
| 78 | grout |
| 82 | backfill |
| 86 | footing key |
| 90 | buttress |
| 94 | counterfort |
| 98 | vertical seam |
| 102 | right end |
| 106 | left end |

DETAILED DESCRIPTION

Various embodiments of the present invention are described herein and as depicted in the drawings. The present disclosure has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. It is expressly understood that although FIGS. 1-6 depict embodiments of precast cantilevered wing walls, the present invention is not limited to these embodiments and may be used in any form of application related to retaining walls or systems and methods to prevent the inadvertent movement of soil.

Referring now to FIG. 1, an embodiment of a precast cantilevered wing wall 10 of the present invention is shown. In the example of FIG. 1, the cantilevered wing wall 10 includes a stem 14 having a predetermined height 18, length 19, and thickness 20. The stem 14 is connected to a footing 22 with a predetermined thickness 23. The stem has a back face 26 and a front face 30. The footing 22 may project laterally a predetermined width 24 from the front face 30 to form a toe 34 and/or from the back face 26 a predetermined width 25 to form a heel 38. In one embodiment, the cantilevered wing wall further comprises anchors 40. The anchors 40 generally have a first portion at least partially embedded in the concrete and a second portion adapted to be engaged by lifting equipment to lift, transport, and/or install the cantilevered wing wall. The anchors 40 may be embedded within at least one of the stem 14 and the footing 22. Optionally, a base shear key 42 extends down a predetermined depth 43 from the heel 38 of the footing 22. The base shear key has a predetermined width 44 extending from the heel 38 in the direction of the toe 34 under the footing 22. The stem height 18, length 19, and thickness 20, footing thickness 23, toe width 24, heel width 25, shear key depth 43, and shear key width 44 may be any dimension required based on the design criteria of the installation. In one embodiment, as shown in FIG. 1, it is anticipated that the shear key 42 may have a depth 43 of 12 inches and a width 44 of 12 inches. However, the base shear key 42 may have any depth 43 or width 44 required by the design criteria of the installation. For example, the base shear key could have a depth 43 of 24 inches and a width 44 of 12 inches. The base shear key 42 can be of any shape such as a tapered shape as illustrated in FIG. 2.

Blockouts 46 are formed through the footing 22 between the stem wall 14 and the base shear key 42. Although the blockouts 46 are shown as generally square shaped, it should be understood that they may be of any shape, including a circle, triangle, rectangle, or parallelogram, or one or more combinations thereof. Additionally, blockouts 46 of different shapes and sizes may be formed through the footing 22. The blockouts 46 may be formed a distance 47 from the heel 38 and a distance 48 from the left and right edges of the footing 22. The blockouts 46 may have a width 49 and a length 50. Any number of blockouts 46 may be formed through the footing 22. A distance 51 may separate each blockout 46 from an adjacent blockout 46. Optionally, the distance 51 may be unequal wherein the blockouts 46 may be spaced irregularly through the footing 22. In one embodiment, illustrated in FIG. 6, the blockouts may be arranged in more than one row from the right end 102 to the left end 106 of the footing 22. In one embodiment, as shown in FIG. 1, the blockouts may be formed a distance 47 of 12 inches from the heel, may be equally spaced a distance 48 of 4 inches from the left and right edges of the footing 22, may have a width 49 of 12 inches and a length 50 of 12 inches, and each blockout may be equally separated from an adjacent blockout by a distance 51 of 4 inches. As will be appreciated by one skilled in the art, the actual length 50 and width 49 of the blockouts and the distances 47, 48, and 51 may vary as required by design criteria for each particular installation. Various dimensions are provided in FIG. 1 to illustrate one exemplary embodiment and it is expressly contemplated that dimensions of the cantilevered wing wall, the base shear key, and the placement, dimensions, and spacing of the blockouts may be varied and still comport with the scope and spirit of the present disclosure. Although not shown, the precast cantilevered wing wall 10 may be reinforced with steel rebar or other materials with high rigidity to help impede movement of the wing wall after installation.

Figure 2:
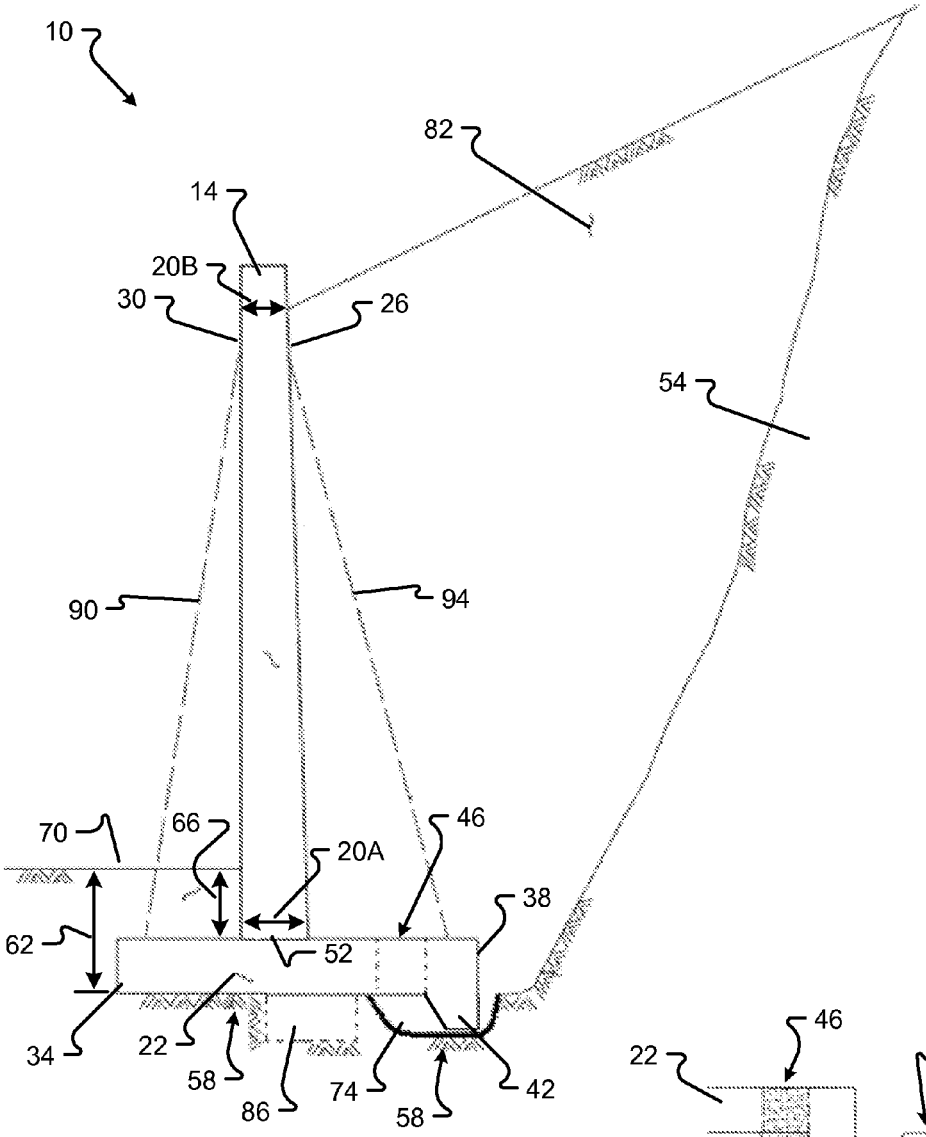
FIG. 2 is a side view of a cantilevered wing wall according to an embodiment.
Figure 3:
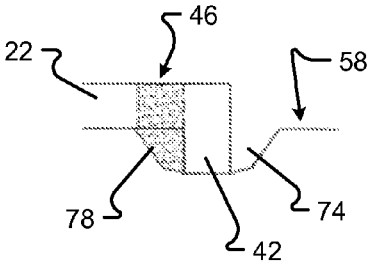
FIG. 3 is fragmentary side view of a cantilevered wing wall according to an embodiment.

FIG. 2 illustrates another embodiment of a precast cantilevered wing wall 10 of the present invention. The stem 14 is connected to the footing 22 at a joint 52 using any material or method known in the art. For example, the stem 14 may be joined to the footing 22 using a key interlocking with a groove or depression. In one embodiment, the cantilevered wing wall 10 may be formed in one piece wherein the stem 14 and the footing 22 are formed together at the same time to form a monolithic precast structure. The back face 26 is generally designed to engage an embankment 54 comprised of soil or other material. The footing 22 is placed on a prepared subgrade 58 excavated to a depth 62 determined so that the footing 22 may be covered to a predetermined depth 66 below the final grade 70. The base shear key 42 fits into a trench 74 dug in the subgrade 58. In an alternate embodiment, after the retaining wall is placed on the subgrade 58, a plurality of soil nails (not illustrated) of any type or size known in the art may optionally be emplaced through the blockouts 46 for further stabilization. As illustrated in FIG. 3, grout 78 is poured through the blockouts 46 to fill the void between the subgrade and footing and the trench 74. Pouring grout 78 into the trench 74 through the blockouts 46 increases the coefficient of friction between the footing and the subgrade 58 soil such that the coefficient of friction for the precast cantilevered wing wall is equivalent to the coefficient of friction of a cast-in-place cantilevered wing wall of a similar size.

Returning to FIG. 2, after the grout material 78 cures, the footing 22 is covered and backfill 82 is placed between the embankment 54 and the back face 26. Also shown in the embodiment of FIG. 2, the footing 22 may optionally include a footing key 86 that extends down from the bottom of the footing 22. Buttresses 90 may optionally be added to the front face 30 and counterforts 94 may optionally be added to the back face 26 based on design criteria. One or both of the back face 26 and the front face 30 may have a batter such that the stem 14 has a thickness 20A near the footing 22 greater than a thickness 20B at the top.

Figure 4:
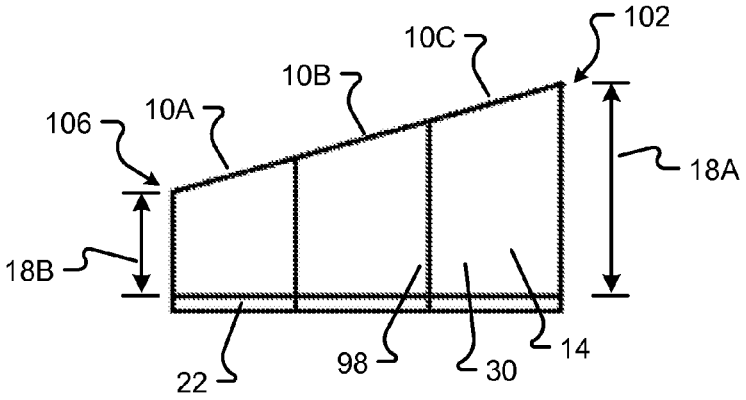
FIG. 4 is a front view of multiple cantilevered wing walls positioned adjacent one another in series according to one embodiment of the present invention.

Referring to FIG. 4, three cantilevered wing walls 10A, 10B, and 10C of another embodiment of the present invention are illustrated. The individual wing walls 10A-C are positioned adjacent one another or aligned at vertical seams 98. Each wing wall 10A-C has a stem 14 with a height 18A greater on the right end 102 than a height 18B on the left end 106 so that in this perspective the front face 30 of the stem 14 is higher on right end 102. In another embodiment, the individual wing walls may be higher on the left end than on the right end providing a negative slope in this perspective. Individual cantilevered wing walls with a positive or negative slope may be positioned adjacent to each other and/or to individual cantilevered wing walls with a constant stem height to produce a profile of a varying height. In one embodiment, individual cantilevered wing walls may be positioned adjacent one another and then joined together using mechanical fasteners, by welding pre-placed joints, with a grout, or one or more other means.

Figure 5:
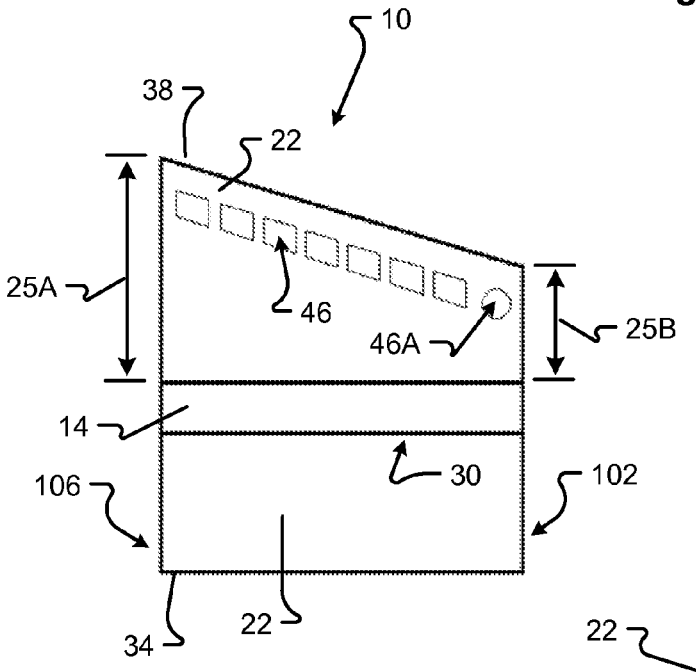
FIG. 5 is a top view of a cantilevered wing wall according to an alternate embodiment of the present invention.

FIG. 5 illustrates yet another embodiment of a cantilevered wing wall. The footing 22 extends away from the stem 14 further on the left end 106 than on the right end 102 giving the footing 22 a trapezoidal shape. Said another way, the heel projection 25A on the left end 106 is larger than the heel projection 25B on the right end 102. Of course, as one skilled in the art will recognize, the right end 102 could extend further than the left end 106. The footing 22 projecting laterally from the front face 30 may also have a trapezoidal or other shape. FIG. 5 also illustrates a circular blockout 46A formed in conjunction with rectangular blockouts 46.

Figure 6:
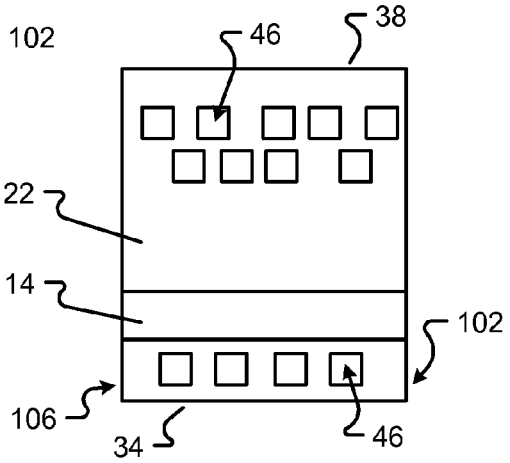
FIG. 6 is a top view of a cantilevered wing wall according to yet another embodiment of the present invention.

FIG. 6 illustrates another embodiment of a cantilevered wing wall. The footing 22 extends away from the stem 14 an equal distance on the left end 106 and on the right end 102. Two rows of blockouts 46 are formed through the footing 22 between the heel 38 and the stem 14. The blockouts 46 have an irregular spacing. Optional blockouts 46 have been formed through the footing 22 between the toe 34 and the stem 14.

Figure 7A:
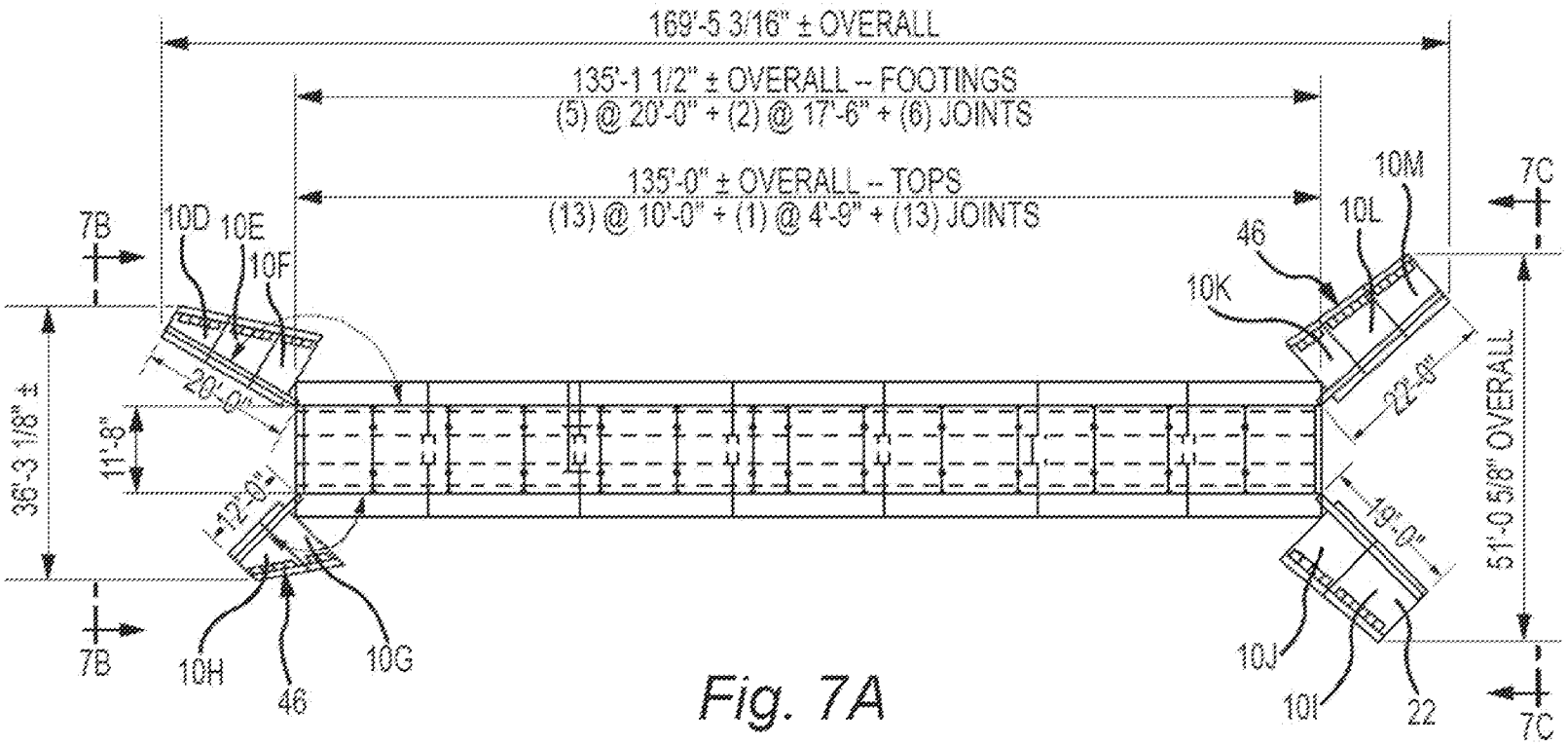
FIG. 7A is a top plan view of multiple cantilevered wing walls positioned adjacent one another in a structure according to an embodiment.
Figure 7B:
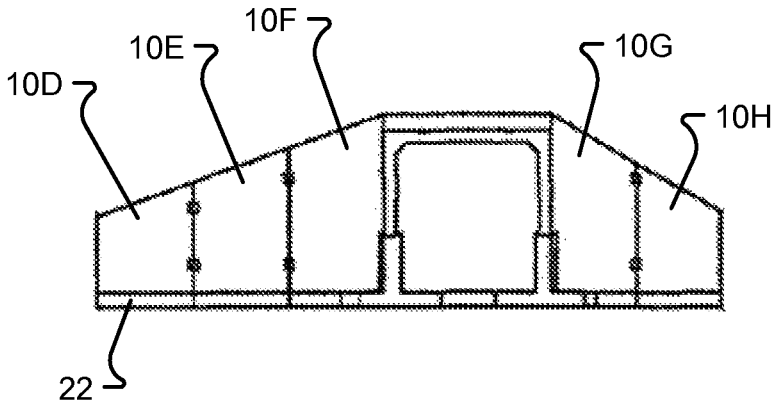
FIG. 7B is a plan view of FIG. 7A on the line 7B.
Figure 7C:
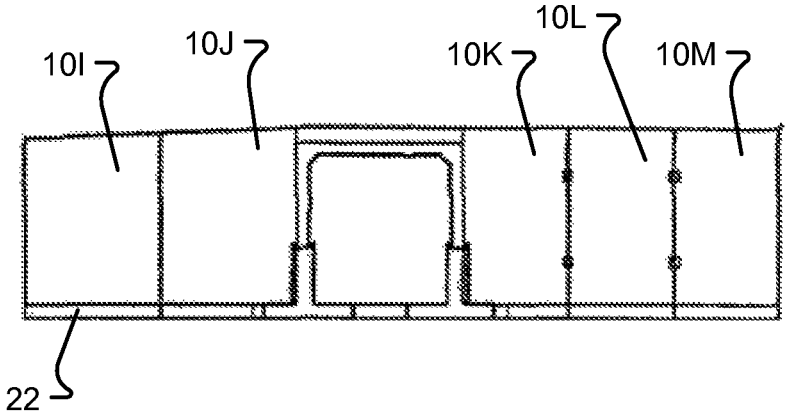
FIG. 7C is a plan view of FIG. 7A on the line 7C.

FIG. 7A illustrates sections of cantilevered wing walls 10D-10M of the present positioned adjacent one another. The cantilevered wing walls 10D-10M are aligned with other precast concrete elements to form a structure. FIG. 7B illustrates a front view of cantilevered wing walls 10D-10H of FIG. 7A. FIG. 7C illustrates a front view of cantilevered wing walls 10I-10M of FIG. 7A. Various dimensions, angles, and alignments of cantilevered wing walls 10D-10M are provided in FIGS. 7A-7C to illustrate exemplary embodiments of sizes, shapes, and alignments of individual cantilevered wing walls. It is expressly contemplated that sizes, shapes, and alignments of the cantilevered wing walls may be varied and still comport with the scope and spirit of the present disclosure.

Some embodiments of the present disclosure may be fabricated to optionally include a variety of simulated material patterns on the front face 30, including but not limited, to simulated block, brick, stone, cut stone, stone block, flagstone, granite, sandstone, as well as other material and patterns known in the art. The invention may also embody a wide variety of different finishes, colors, and textures such as those commonly utilized in the architectural and stone industries to provide a high quality appearance compatible with any surrounding development.

In one embodiment, the cantilevered wing wall may be formed and cast on site, for example, using poured concrete. In some embodiments, other materials may be used including, but not limited to, plastic, polymer concrete, or similar materials that may be represented in a variety of types and composition mixes having various combinations of ingredients such as those found in the manufacture of concrete, plastics, polymers, cement, water, cementitious materials, and chemical and or mineral admixtures, coloring agents which, when combined, will create a concrete material. In one embodiment, blockouts may optionally be formed through the footing between the toe and the stem. In some embodiments, the cantilevered wing wall may optionally be formed without a base shear key or a footing key.

The present invention has many benefits compared to prior art cantilevered wing walls. Because the precast cantilevered wing wall of the present invention is more resistant to lateral forces than prior art precast retaining walls, the width of the footing and height of the stem can be reduced, decreasing the amount of material that must be excavated and reducing the amount of material used in the cantilevered wing wall. In addition, installation time may be reduced because if additional stability is required, soil nails may be installed through the blockouts without drilling through the footing. The precast cantilevered wing wall of the present invention is less expensive to manufacture and has a coefficient of friction equivalent to a cast-in-place retaining wall of similar size. The precast cantilevered wing wall of the present invention may also be manufactured in controlled conditions and under close observation resulting in a stronger, more reliable structure.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An integrally formed precast cantilevered concrete wing wall adapted to retain a soil embankment, comprising:

a substantially vertically oriented stem with a predetermined height, length, and thickness;

at least one anchor embedded in the stem for lifting and lowering the precast cantilevered wing wall, the at least one anchor comprising a first portion at least partially embedded in the concrete of the stem and a second portion adapted to be engaged by a lift apparatus;

a footing connected at a substantially right angle to the stem, the footing and the stem formed together as one integral precast structure without joints, the footing having a toe extending laterally from a front face of the stem and a heel extending laterally from a back face of the stem;

a base shear key positioned proximate to the heel at a distal portion of the footing, the base shear key extending in a downward direction from a horizontal plane defined by the footing to a predetermined depth, wherein the base shear key is adapted to extend into a trench excavated to receive the base shear key; and a plurality of blockouts formed through the footing and positioned proximate to the base shear key and in communication with the trench, wherein a grout material can be introduced through the plurality of blockouts to contact the base shear key and fill at least a portion of the trench to provide additional support and to anchor the precast cantilevered wing wall to the surrounding soil, and wherein the grout material adheres to the base shear key.

2. The integrally formed precast cantilevered wing wall of claim 1, wherein the plurality of blockouts and the base shear key are formed substantially parallel to the stem.

3. The integrally formed precast cantilevered wing wall of claim 1, wherein the plurality of blockouts are arranged along substantially an entire length of the base shear key.

4. The integrally formed precast cantilevered wing wall of claim 3, wherein a distal edge of each of the plurality of blockouts that is distal to the stem is positioned approximately 12 inches from the distal portion of the footing.

5. The integrally formed precast cantilevered wing wall of claim 3, wherein the plurality of blockouts form one row of blockouts.

6. The integrally formed precast cantilevered wing wall of claim 3, wherein, when grout is introduced through the plurality of blockouts into the trench, the grout increases the coefficient of friction of the precast cantilevered wing wall to be approximately equivalent to the coefficient of friction of a cast-in-place cantilevered wing wall of a similar size.

7. The integrally formed precast cantilevered wing wall of claim 1, wherein the plurality of blockouts have an irregular spacing.

8. The integrally formed precast cantilevered wing wall of claim 1, wherein the plurality of blockouts have a shape resembling at least one of a parallelogram, a square, a rectangle, and a triangle.

9. The integrally formed precast cantilevered wing wall of claim 1, wherein at least one blockout of the plurality of blockouts is formed through the toe.

10. The integrally formed precast cantilevered wing wall of claim 1, wherein the base shear key has a continuous length that extends from a first side of the footing to a second side of the footing.

11. The integrally formed precast cantilevered wing wall of claim 1, wherein the base shear key extends downwardly a distance at least about equal to the thickness of the footing.

12. The integrally formed precast cantilevered wing wall of claim 1, wherein the precast cantilevered wing wall is poured in place into a form at a precast plant.

13. The integrally formed precast cantilevered wing wall of claim 1, wherein a first height of a first side of the stem is greater than a second height of a second side of the stem.

14. The integrally formed precast cantilevered wing wall of claim 1, wherein the cantilevered wing wall is devoid of a counterfort between the stem and the footing.

15. The integrally formed precast cantilevered wing wall of claim 1, wherein the plurality of blockouts are positioned between the stem and the distal portion of the footing.

16. The integrally formed precast cantilevered wing wall of claim 3, wherein each of the plurality of blockouts has a length no greater than about 12 inches and a width no greater than about 12 inches.

17. The integrally formed precast cantilevered wing wall of claim 10, further comprising a footing key extending in a downward direction from the footing.

18. The integrally formed precast cantilevered wing wall of claim 17, wherein the footing key is positioned at least partially under the stem.

19. The integrally formed precast cantilevered wing wall of claim 18, wherein at least one blockout of the plurality of blockouts is positioned between the footing key and the base shear key.

* * * * *